US011089851B2

(12) United States Patent
Leaks, Jr.

(10) Patent No.: US 11,089,851 B2
(45) Date of Patent: Aug. 17, 2021

(54) SHOE TOTE

(71) Applicant: Shoe Pac LLC, Dallas, TX (US)

(72) Inventor: James Leaks, Jr., Fort Worth, TX (US)

(73) Assignee: SHOE PAC LLC, Dallas, TX (US)

( * ) Notice: Subject to any disclaimer, the term of this patent is extended or adjusted under 35 U.S.C. 154(b) by 0 days.

(21) Appl. No.: 16/282,574

(22) Filed: Feb. 22, 2019

(65) Prior Publication Data

US 2019/0254396 A1 Aug. 22, 2019

Related U.S. Application Data

(60) Provisional application No. 62/633,985, filed on Feb. 22, 2018.

(51) Int. Cl.

| | |
|---|---|
| ***A45C 3/12*** | (2006.01) |
| ***A45F 3/02*** | (2006.01) |
| ***A45C 3/00*** | (2006.01) |
| ***A45F 5/00*** | (2006.01) |
| ***A45C 13/30*** | (2006.01) |

(52) U.S. Cl.

CPC ..... *A45C 3/12* (2013.01); *A45C 3/001* (2013.01); *A45F 3/02* (2013.01); *A45F 5/00* (2013.01); *A45C 2003/005* (2013.01); *A45C 2013/306* (2013.01)

(58) Field of Classification Search

CPC ..... A45C 3/12; A45F 3/02

See application file for complete search history.

(56) References Cited

U.S. PATENT DOCUMENTS

| | | | | |
|---|---|---|---|---|
| 2,276,765 | A * | 3/1942 | De Gree | A45C 3/12 206/278 |
| 2,625,752 | A * | 1/1953 | Kemp | A43B 3/20 36/72 R |
| 2,672,263 | A * | 3/1954 | Alber | A45F 5/00 224/602 |
| 2,813,602 | A | 11/1957 | Macarthur | |
| 3,313,047 | A * | 4/1967 | Svien | A43B 5/18 36/7.3 |
| 3,796,357 | A | 3/1974 | Johnson | |
| D234,326 | S | 2/1975 | Kato | |
| D247,524 | S | 3/1978 | Graham | |
| 4,083,483 | A * | 4/1978 | Bayless | A47G 25/005 206/278 |
| 4,126,256 | A * | 11/1978 | McGruder | A63C 3/00 206/294 |

(Continued)

*Primary Examiner* — Nathan J Newhouse
*Assistant Examiner* — Lester L Vanterpool
(74) *Attorney, Agent, or Firm* — Goodhue, Coleman & Owens, P.C.

(57) ABSTRACT

A shoe tote includes a first and a second shoe sock each with a first and second opposing side walls spaced apart by a bottom portion and a back portion. Each shoe sock has an exterior and an interior portion, designed to receive footwear. Each shoe socks contain a top portion opposing the bottom portion and a front portion opposing the back portion. Each shoe sock contains a closure mechanism. The shoe socks are separated by a strap. The strap has a first terminal end and a second terminal end. The strap further contains a first attachment disposed between the first terminal end of the strap and the first shoe sock. The strap also is comprised of a second attachment disposed between the second terminal end of the strap and the second shoe sock.

14 Claims, 14 Drawing Sheets

(56) References Cited

U.S. PATENT DOCUMENTS

D254,343 S 3/1980 Babcock
4,258,869 A 3/1981 Hilgendorff
4,296,499 A * 10/1981 Patterson ..... A43B 23/28 2/239
D272,428 S 1/1984 Kelley
4,514,915 A * 5/1985 Galetta ..... A43B 5/0415 36/1
D292,847 S 11/1987 Barker
5,129,560 A * 7/1992 Herman ..... A45F 3/00 224/153
D339,680 S * 9/1993 Hodges, Jr. ..... D2/912
D350,435 S 9/1994 Smith
5,513,787 A * 5/1996 Reed ..... A45C 3/12 224/602
5,730,287 A 3/1998 Martin
D408,137 S 4/1999 Leininger
D408,138 S 4/1999 Mracna
6,010,050 A 1/2000 Tarr
6,446,849 B1 * 9/2002 Schleifer ..... A43B 5/0425 224/258
6,584,704 B2 * 7/2003 March ..... A43B 3/163 36/7.1 R
6,869,219 B1 * 3/2005 Sala ..... A45C 3/12 150/111
D578,763 S * 10/2008 Walker ..... A43B 5/0415 D3/231
D607,638 S 1/2010 Hensley et al.
D641,170 S * 7/2011 Thompson ..... D3/319
D674,189 S * 1/2013 Robinson ..... D3/269
D687,635 S * 8/2013 Choi ..... D3/317
9,516,935 B2 * 12/2016 Rohe ..... A45C 7/0086
9,635,900 B1 * 5/2017 Rolle ..... A43B 3/20
9,770,086 B2 * 9/2017 Prisco ..... A45C 13/30
10,165,841 B2 * 1/2019 Dalton ..... A45C 3/12
2004/0016785 A1 1/2004 Timmons
2004/0163279 A1 * 8/2004 Gadson ..... A45C 3/12 36/7.1 R
2005/0035169 A1 2/2005 Tabor et al.
2005/0274765 A1 12/2005 Fischel
2007/0039841 A1 * 2/2007 Deloatch-Ratliff ..... B65D 85/187 206/278
2007/0272570 A1 * 11/2007 Brooks ..... A43B 5/0425 206/315.9
2008/0011567 A1 * 1/2008 Hammond ..... A45C 7/009 190/108
2010/0284631 A1 * 11/2010 Lee ..... A45C 3/06 383/12
2011/0101052 A1 * 5/2011 Armstrong ..... A45F 3/14 224/254
2014/0109437 A1 * 4/2014 Burr ..... A01M 31/00 36/7.1 R
2016/0095400 A1 * 4/2016 Lawton ..... A45C 3/12 206/292
2017/0143104 A1 * 5/2017 Vera ..... A45C 3/12
2017/0150774 A1 * 6/2017 Girard ..... A43B 5/18
2017/0172287 A1 * 6/2017 Prisco ..... A45C 13/30
2018/0042351 A1 * 2/2018 Dalton ..... A45C 7/0086

* cited by examiner

SHOE TOTE

CROSS REFERENCE TO RELATED APPLICATION

This application claims priority under 35 U.S.C. § 119 to provisional application Ser. No. 62/633,985 filed Feb. 22, 2018, which is hereby incorporated by reference in its entirety.

FIELD OF THE INVENTION

The present invention relates to apparel for toting shoes. More particularly, but not exclusively, the present invention relates to a shoe tote.

BACKGROUND

Athletics bags that carry sports equipment and footwear of various shapes and sizes are well known. Advancements are continually made to athletic bags. Generally athletic bags contain one bag in which the user stores all his or her equipment and footwear. When the user stores his or her footwear in the bag, the footwear may be come uneasy to locate quickly and do not conform to the interior of the athletic bag. Such athletic bags may become bulky and uncomfortable to carry once shoes are stored in the athletic bag. Therefore, what is needed is an easy to carry shoe tote designed to conveniently store and easily locate athletic shoes.

SUMMARY

Therefore, it is a primary object, feature, or advantage of the present invention to improve over the state of the art.

It is a further object, feature, or advantage of the present invention to provide for a way to transport athletic shoes separately that is not cumbersome.

It is a still further object, feature, or advantage of the present invention to provide a way to carry athletic shoes with vented and breathable material to combat smelly odors.

According to one aspect, a shoe tote includes a first and a second shoe sock each with a first and second opposing side walls spaced apart by a bottom portion and a back portion. The first and second shoe socks have an exterior portion and an interior portion designed to receive footwear. The first and second shoe socks contain a top portion opposing the bottom portion and a front portion opposing the back portion. Each shoe sock contains a closure mechanism, designed to conveniently store the footwear, wherein the opposing edges of the first and second side walls are noncontiguous in the closed position and contiguous in the open position, the closure mechanism may be located on the back of the shoe. The closure mechanism may be comprised of Velcro; a zipper; at least one button; at least one snap; lace with or without grommets; elastic; magnets; aluminum clasps; or at least one buckles. The shoe socks are separated by a strap which contains an inner surface with an opposing outer surface and a first edge opposing a second edge along the length of the strap separated by the length of the strap. The strap has a first terminal end and a second terminal end. The strap further contains a first attachment disposed between the first terminal end of the strap and the first shoe sock. The strap also is comprised of a second attachment disposed between the second terminal end of the strap and the second shoe sock.

The shoe tote may further include shape forming material, a cleanser shoe surface, a side viewing panel, at least double layered shoe sock comprised of an inner layer and an outer layer. The bottom layer of at least one shoe sock contains a protective puncture pad. The strap may have an adjustable mechanism containing at least one of the following: a slider; a buckle; a button; rings; hooks; zippers; snaps; clips; latches; clasps; or Velcro. The first and/or second attachment method may be comprised of a detachable mechanism containing at least one of the following: hooks; rings; buttons; zippers; clasp; Velcro. The first and/or second attachment method may be nondetachable. The strap may also contain a cushioning pad on the inner surface of the strap. The shoe tote system may also contain at least one an additional storage pocket with a closure mechanism that may be comprised of at least one or more of the following: Velcro; a zipper; at least one button; at least one snap; lace with or without grommets; elastic; magnets; aluminum clasps; or at least one buckles, wherein the opposing edges of the first and second side was are contiguous in the closed position and noncontiguous in the open position. At least one additional pocket may be designed to hold an electronic device and may contain a media port allowing a cable to connect to the electronic device. At least one additional pocket of the shoe tote system may be an ID pocket, contain a hoodie, a cooling gel towel, a vibration pack, a key ring, a hook.

Another aspect of the shoe tote for toting footwear includes a first and a second shoe sock each with a first and second opposing side walls spaced apart by a bottom portion configured to the ground contacting surface of the footwear and a back portion. The first and second shoe socks have an exterior portion and an interior portion designed to receive one or more types of footwear have a ground contacting surface. The first and second shoe socks contain a top portion opposing the bottom portion and a front portion opposing the back portion. Each shoe sock contains a closure mechanism, designed to conveniently store the footwear, wherein the opposing edges of the first and second side walls are noncontiguous in the closed position and contiguous in the open position, the closure mechanism may be located on the back of the shoe. The closure mechanism may be comprised of Velcro; a zipper; at least one button; at least one snap; lace with or without grommets; elastic; magnets; aluminum clasps; or at least one buckles. The shoe socks are separated by a strap which contains an inner surface with an opposing outer surface and a first edge opposing a second edge along the length of the strap separated by the length of the strap. The strap has a first terminal end and a second terminal end. The strap further contains a first attachment disposed between the first terminal end of the strap and the first shoe sock. The strap also is comprised of a second attachment disposed between the second terminal end of the strap and the second shoe sock. The strap of the shoe tote may be worn over the user's shoulder, around the neck, or carried by the user. The bottom of the shoe tote may contain a protective puncture pad. The shoe tote system may also contain at least one an additional storage pocket with a closure mechanism that may be comprised of at least one or more of the following: Velcro; a zipper; at least one button; at least one snap; lace with or without grommets; elastic; magnets; aluminum clasps; or at least one buckles, wherein the opposing edges of the first and second side was are contiguous in the closed position and noncontiguous in the open position. The shoe tote system may also contain at least one additional storage bag by an attachment method containing at least one of the following: Velcro, a zipper, a button, lace with or without grommets, elastic, a magnet, an aluminum clasp, a buckle.

Another aspect of the shoe tote for toting footwear includes a first and a second shoe sock each with a first and second opposing side walls spaced apart by a bottom portion configured to the ground contacting surface of the footwear and a back portion. The first and second shoe socks have an exterior portion and an interior portion designed to receive one or more types of footwear having a ground contacting surface. The first and second shoe socks contain a top portion opposing the bottom portion and a front portion opposing the back portion. Each shoe sock contains a closure mechanism, designed to conveniently store the footwear, wherein the opposing edges of the first and second side walls are noncontiguous in the closed position and contiguous in the open position, the closure mechanism may be located on the back of the shoe. The closure mechanism may be located on the back of at least one shoe sock. The closure mechanism may be comprised of Velcro; a zipper; at least one button; at least one snap; lace with or without grommets; elastic; magnets; aluminum clasps; or at least one buckle. The bottom of the shoe tote may contain a protective puncture pad. The shoe tote system may also contain at least one an additional storage pocket with a closure mechanism that may be comprised of at least one or more of the following: Velcro; a zipper; at least one button; at least one snap; lace with or without grommets; elastic; magnets; aluminum clasps; or at least one buckle, wherein the opposing edges of the first and second side was are contiguous in the closed position and noncontiguous in the open position. The shoe tote system may also contain at least one additional storage bag by an attachment method containing at least one of the following: Velcro, a zipper, a button, lace with or without grommets, elastic, a magnet, an aluminum clasp, a buckle. At least one additional pocket may be designed to hold an electronic device and may contain a media port allowing a cable to connect to the electronic device. At least one additional pocket of the shoe tote system may be an ID pocket, contain a hoodie, a cooling gel towel, a vibration pack, a key ring, a hook. The shoe tote may be comprised of shape forming material. The shape forming material may be breathable. One or more of these and/or other objects, features, or advantages of the present invention will become apparent from the specification and claims that follow. No single embodiment need provide each and every object, feature, or advantage. Different embodiments may have different objects, features, or advantages. Therefore, the present invention is not to be limited to or by an objects, features, or advantages stated herein.

DETAILED DESCRIPTION

Figure 1A:
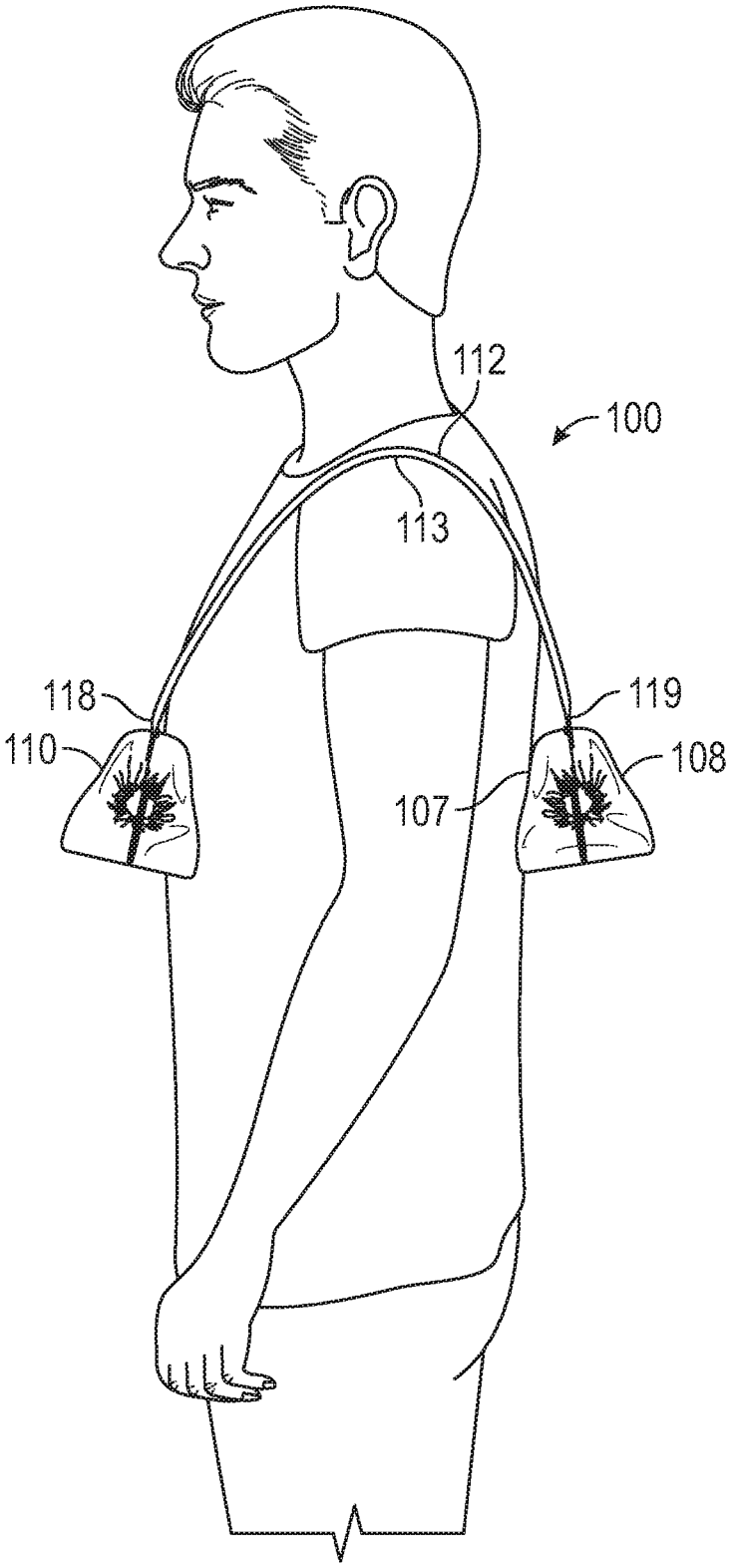
FIG. 1A is a view of the user carrying the shoe tote 100 over one shoulder.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations or modifications in the illustrated device, and any further applications of the principles of the invention as illustrated therein are contemplated as would normally occur to one skilled in the art to which the invention relates.

Figure 1B:
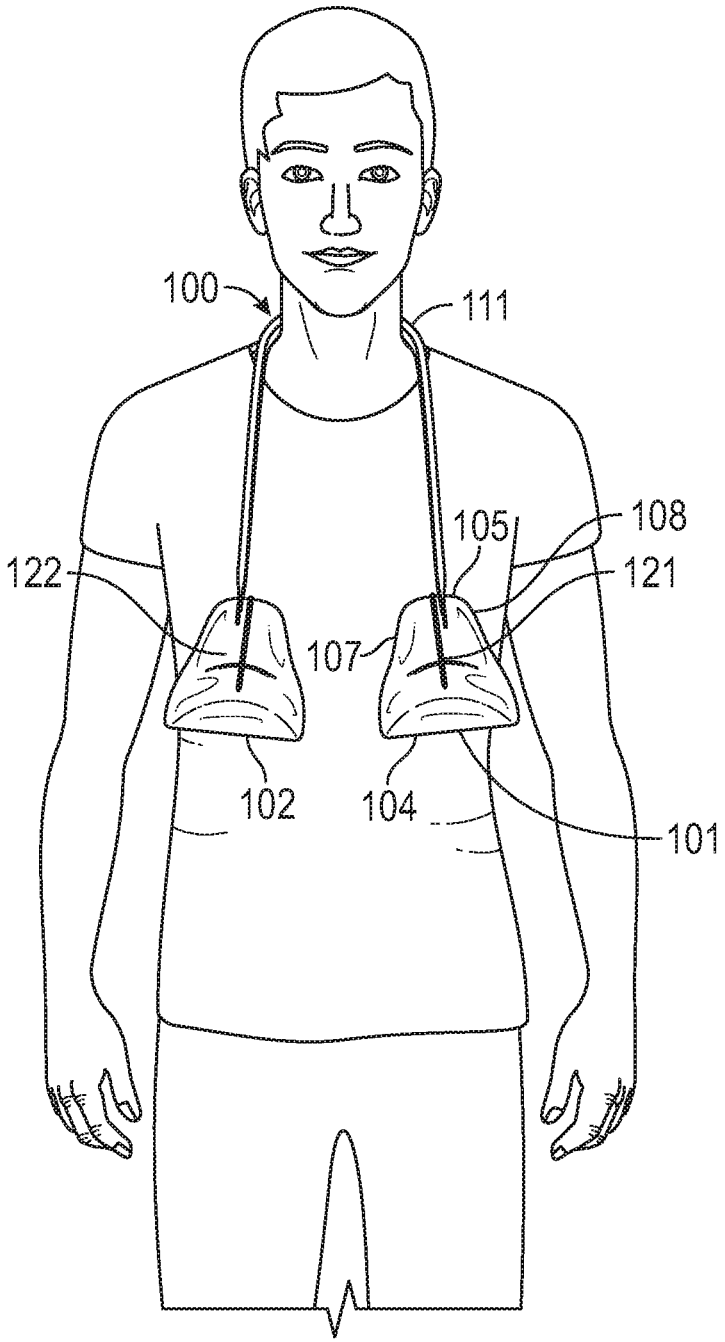
FIG. 1B is a view of the user carrying the shoe tote 100 around his or her neck.
Figure 1C:
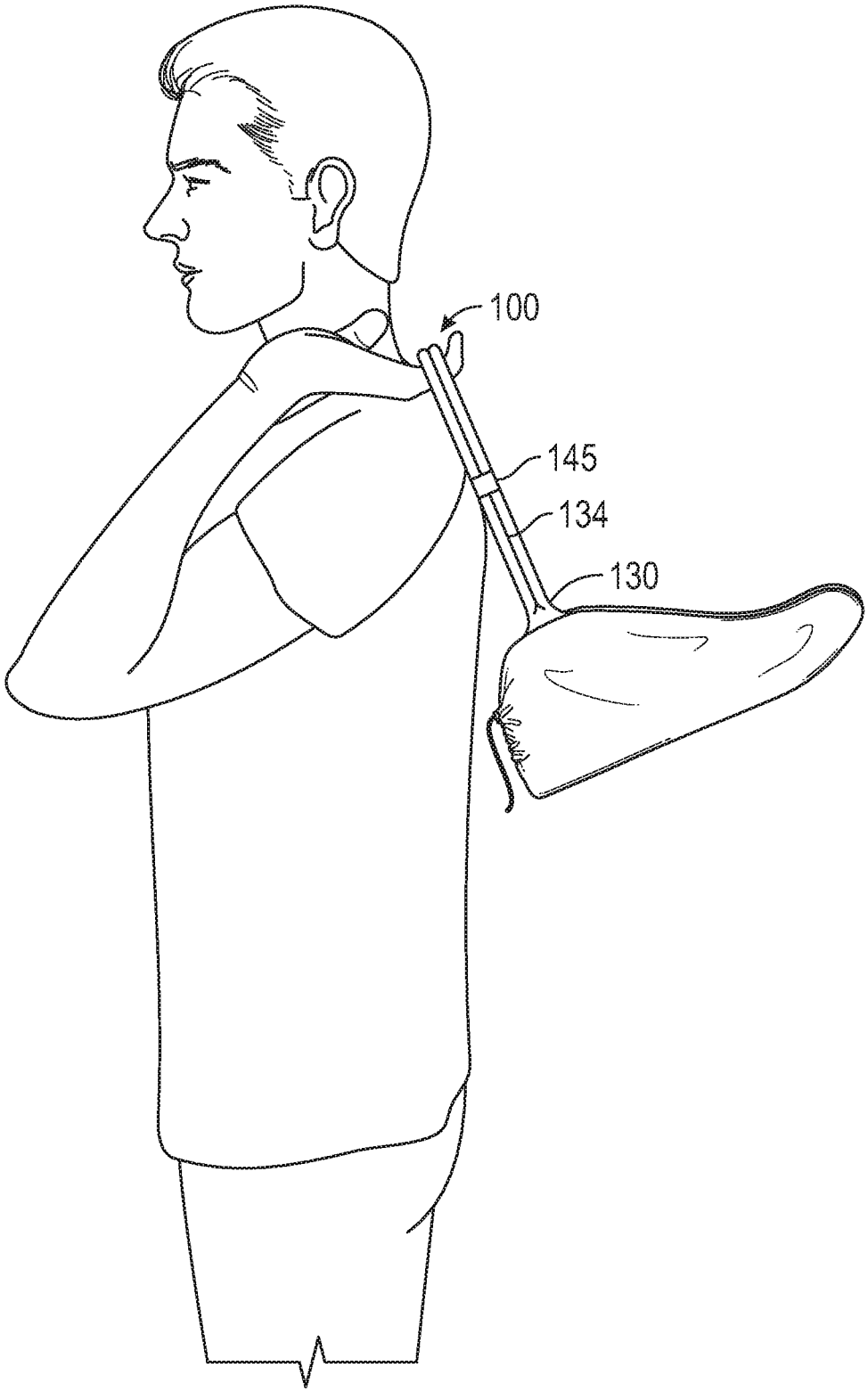
FIG. 1C. is a view of the user carrying the shoe tote 100 by hand.
Figure 2A:
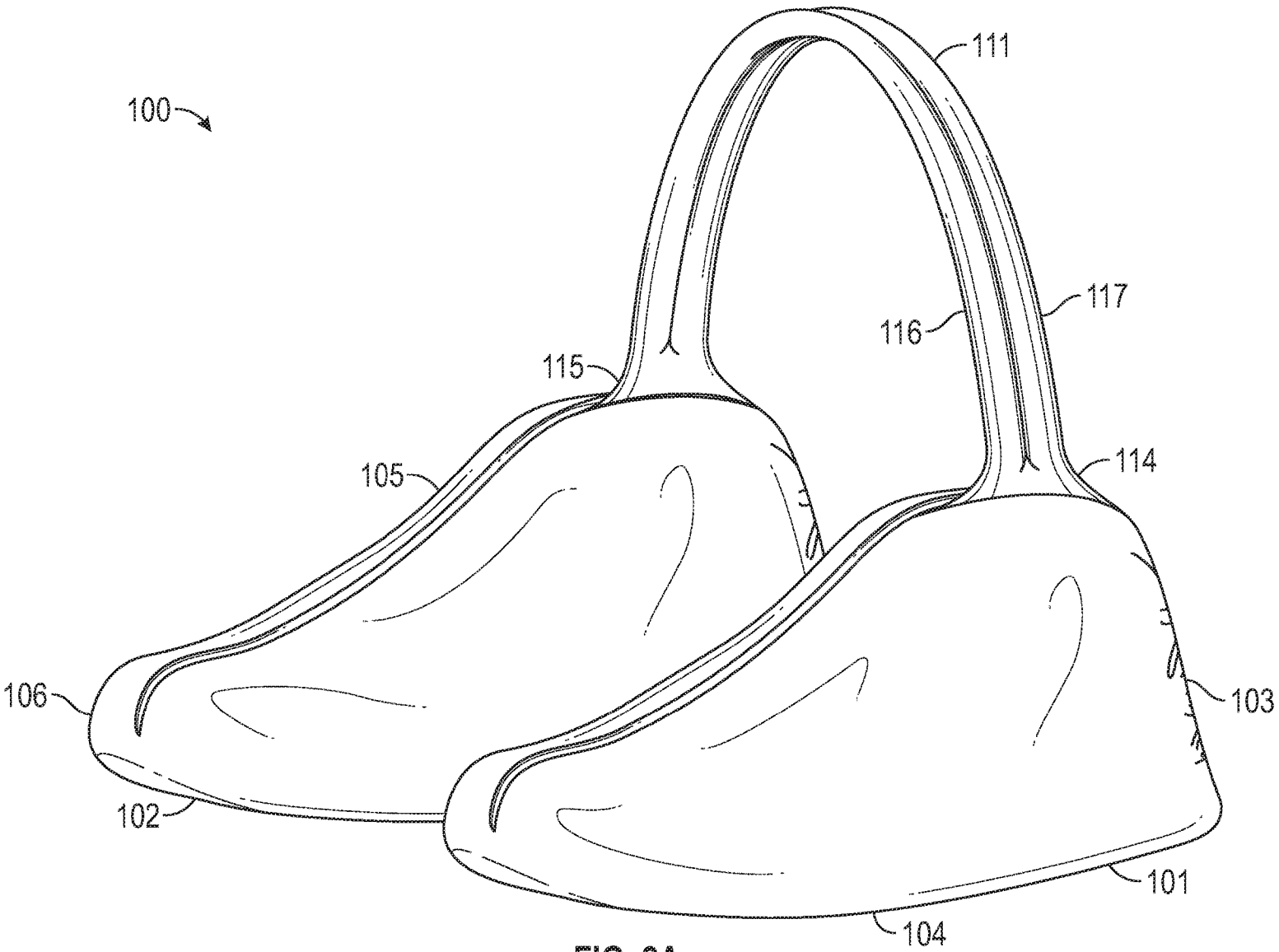
FIG. 2A is a perspective view of a shoe tote shoe tote 100 in accordance with one embodiment of the present invention.
Figure 2B:
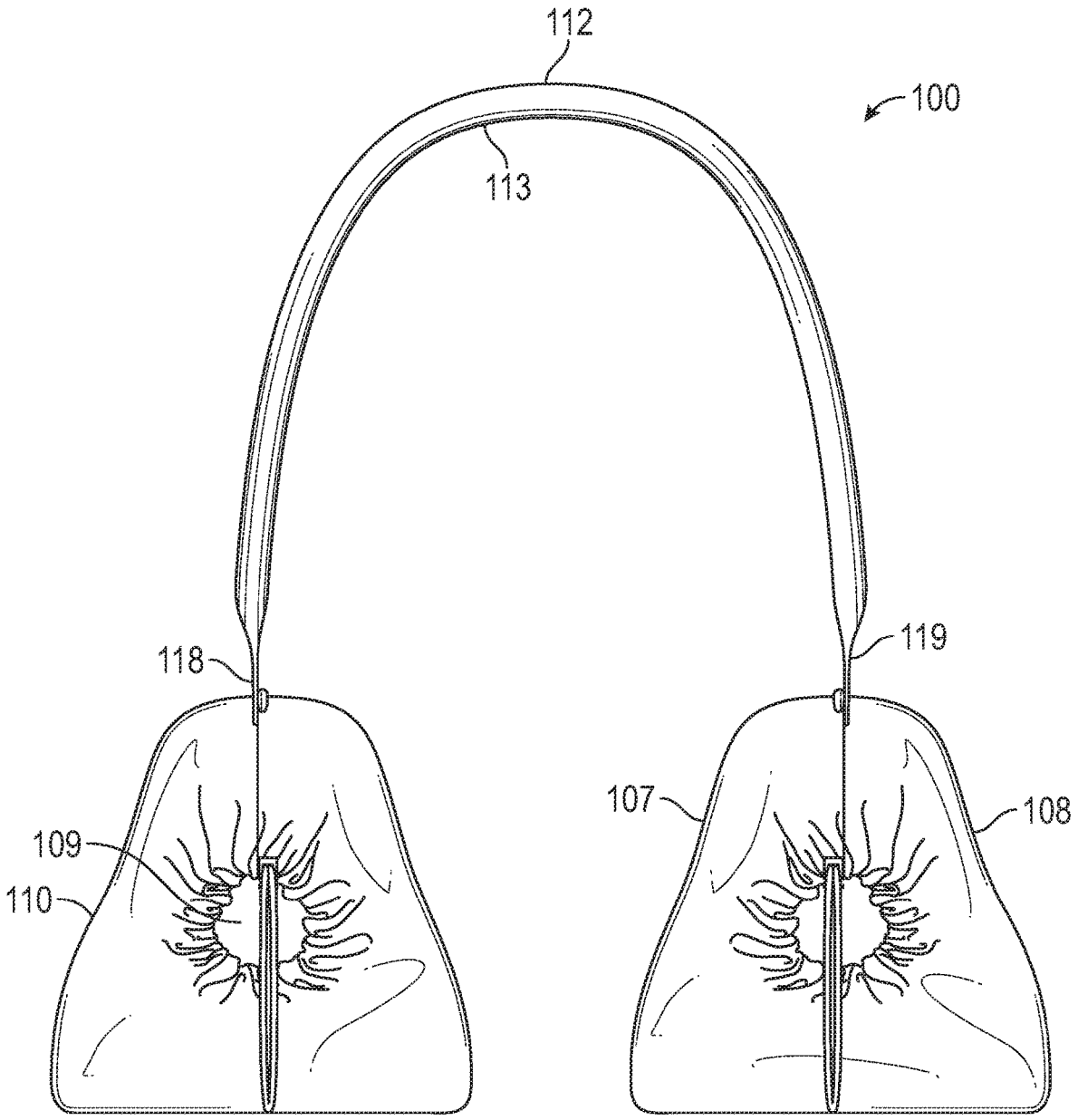
FIG. 2B is a back view of the shoe tote 100 in accordance with one embodiment of the present invention.
Figure 2C:
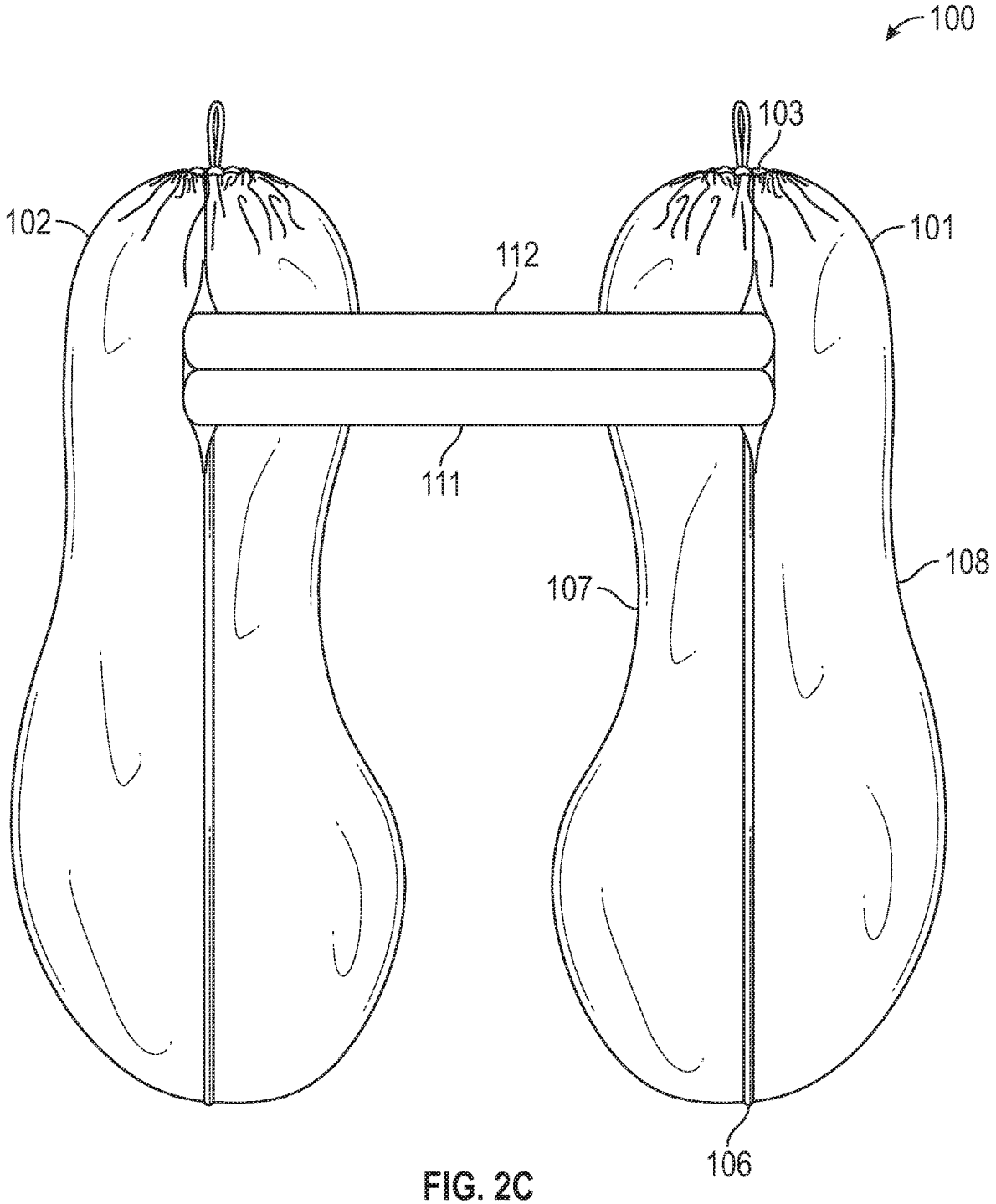
FIG. 2C is the top view of the shoe tote 100 in accordance with one embodiment of the present invention.
Figure 2D:
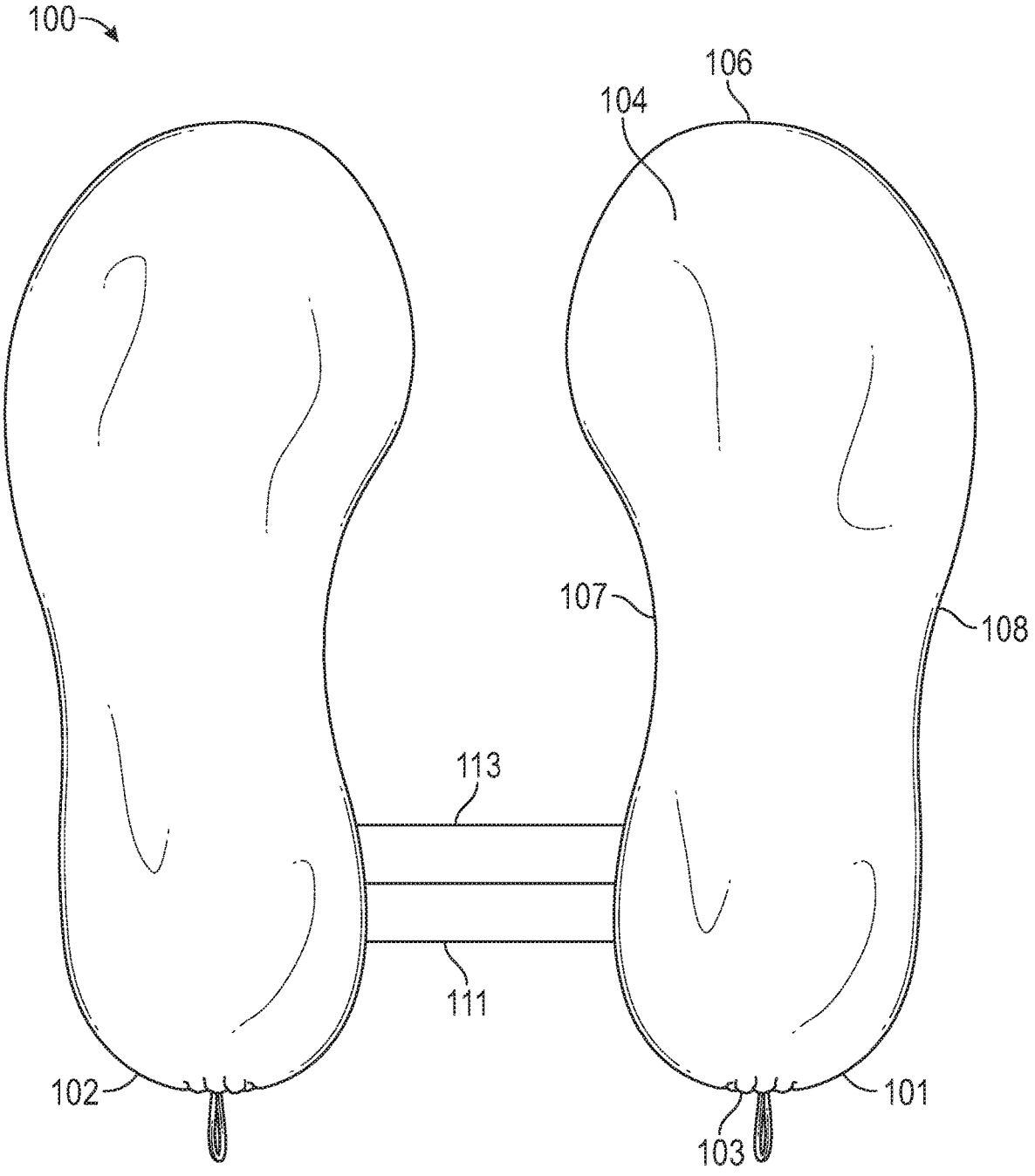
FIG. 2D is a bottom view of the shoe tote system 100 in accordance with one embodiment of the present invention.

Referring to FIGS. 1A-C, there is shown a shoe tote 100 in accordance with one embodiment of the present invention. The shoe tote can be carried multiple ways by the user including over one shoulder as shown by FIG. 1A, around the neck as shown by FIG. 1B, and carried by hand as shown by FIG. 1C. In another embodiment shoe tote 100 may be carried on the forearm of the user. The shoe tote 100 allows a user to conveniently store, protect, and easily locate athletic shoes.

Figure 8:
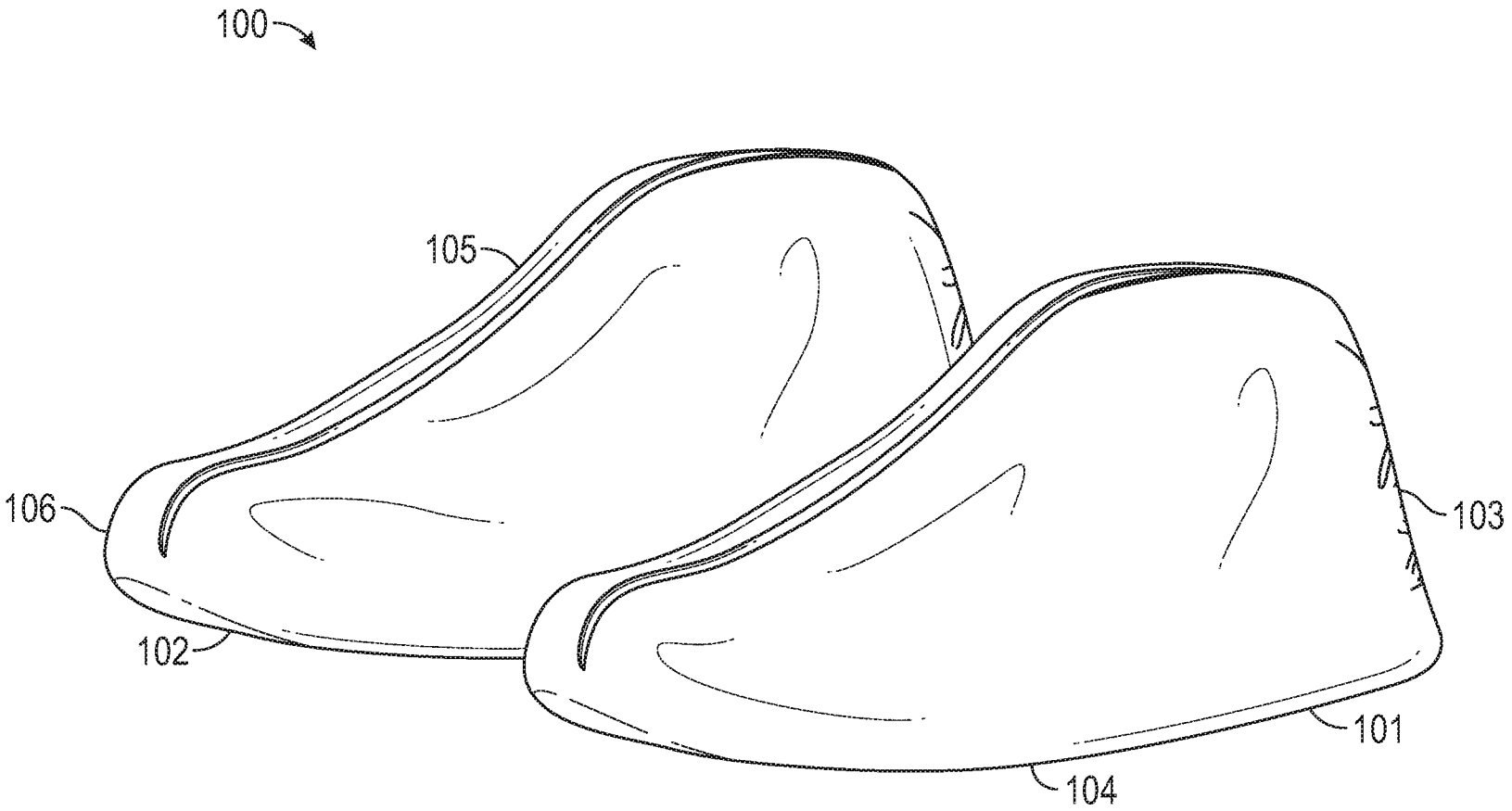
FIG. 8 is a perspective view of shoe tote 100 in accordance with another alternative embodiment of the present invention.

Referring to FIGS. 2A-D a shoe tote 100 is shown in accordance with one embodiment of the present invention. The shoe tote system 100 generally includes two individual shoe tote or shoe socks may include a connected strap 111 as shown by FIGS. 2A-D. The shoe totes may be designated as first shoe sock 101 and second shoe sock 102 for description herein or for reference in a particular situation where a first and second footwear combination warrants a difference between the two shoe socks, but in most instances, there is not intended to be a perceived difference between the shoe socks as far as the terms first and second are concerned. In another embodiment, the shoe tote 100 may include first shoe sock 101 and second shoe sock 102 as shown in FIG. 8.

Figure 5:
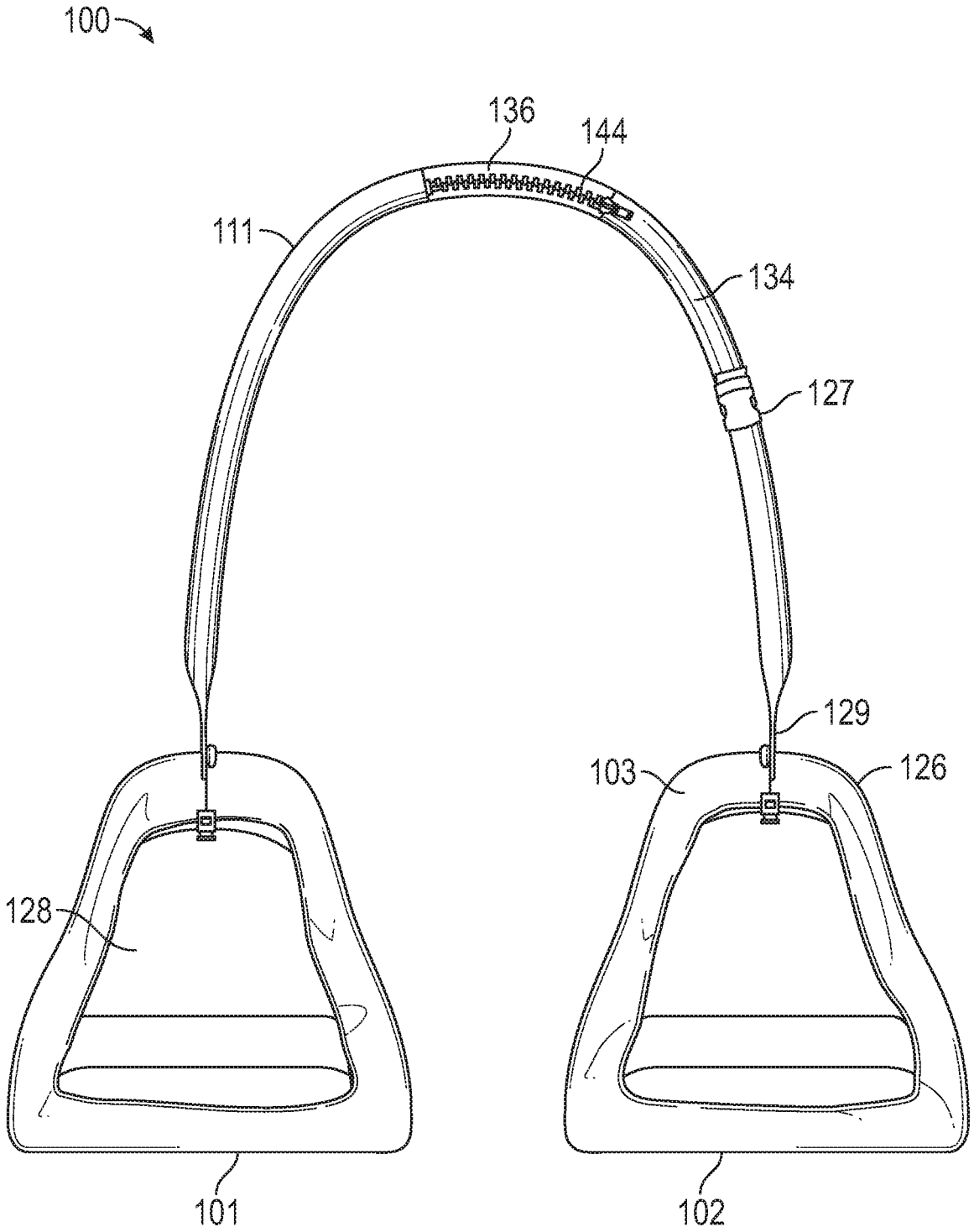
FIG. 5 is a back view of shoe tote 100 showing the double layered sock and adjustable mechanism in accordance with alternative embodiments of the invention.
Figure 6:
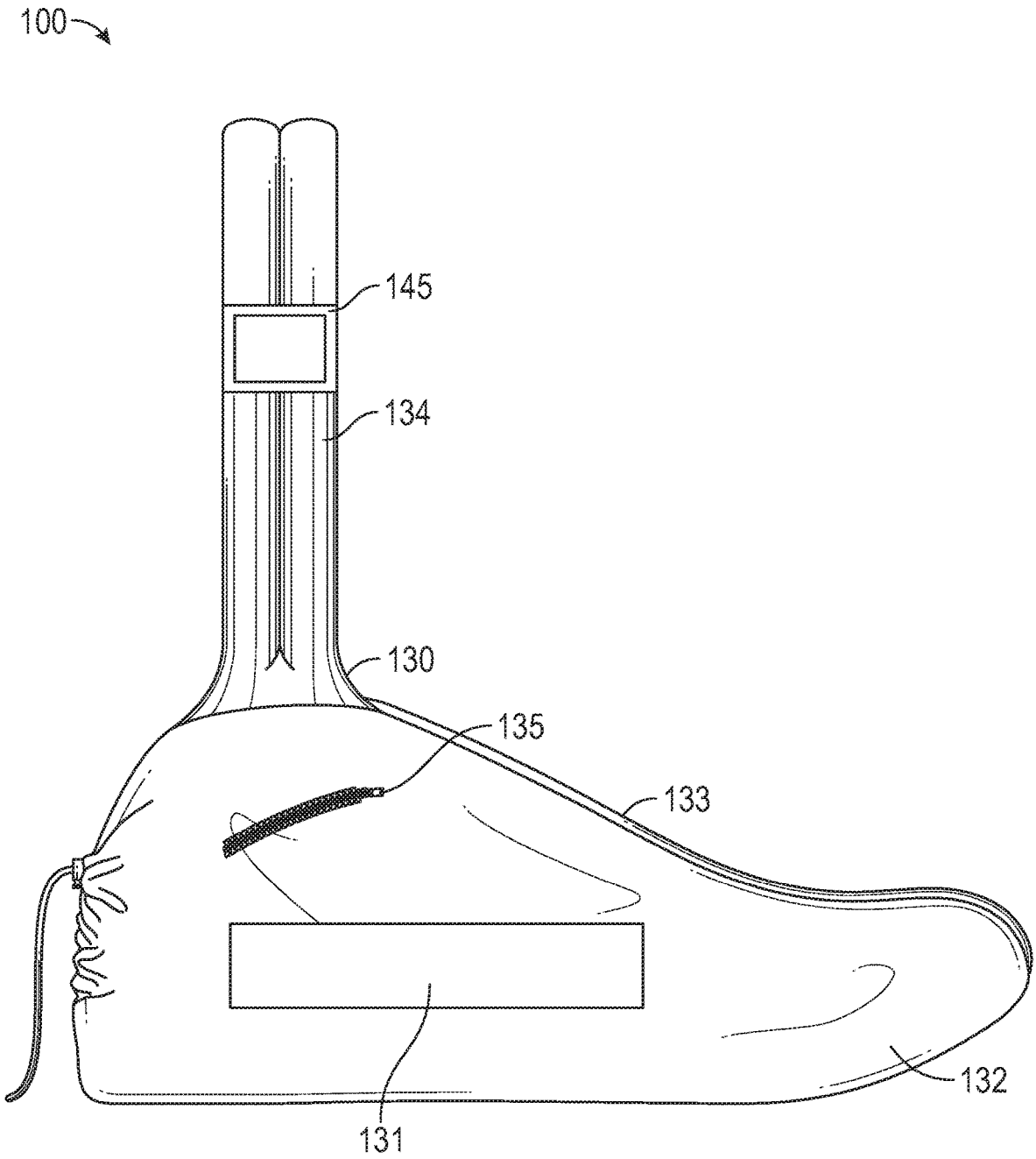
FIG. 6 is a side view of shoe tote 100 in accordance with another embodiment of the present invention
Figure 7:
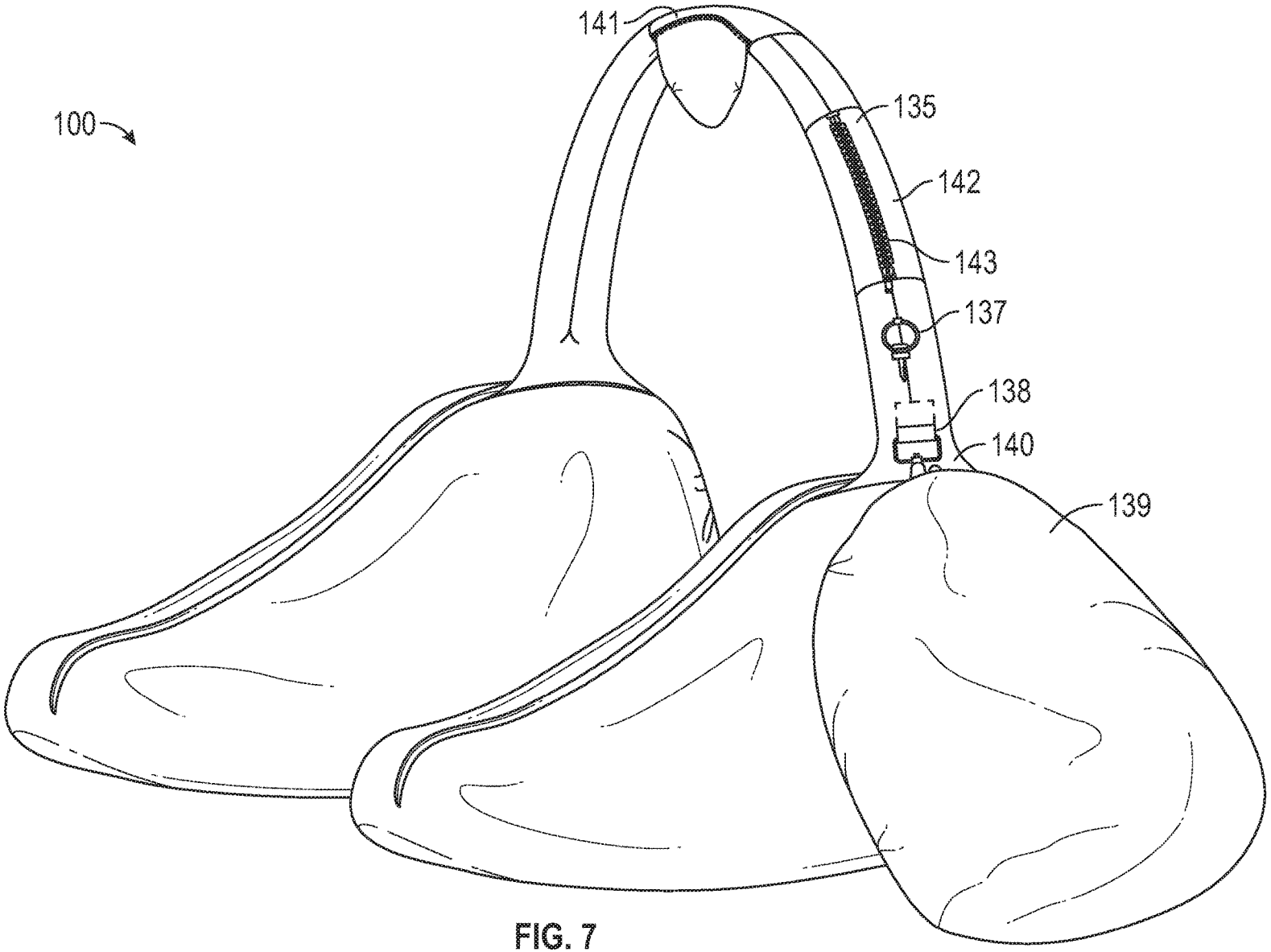
FIG. 7 is a perspective view of shoe tote 100 in accordance with an alternative embodiment of the present invention.

Strap 111 has a length between a first terminal end 114 and an opposing second terminal end 115. In one embodiment strap 111 is one length 21 inches. In another embodiment strap 111 may vary in length. Strap 111 has an outer surface 112 and an opposing inner surface 113. Strap 111 has a first edge 116 and a second edge 117 running the length of strap 111 separated by the outer surface 112 and the opposing inner surface 113. Strap 111 has a first attachment 118 disposed between the first terminal end 114 and the first shoe sock 101. Strap 111 has a second attachment 119 disposed of between the second terminal end 115 and the second shoe sock 102. First attachment 118 and second attachment 119 may be attached to the shoe sock in various ways. In one embodiment one or both first attachment 118 and the second attachment 119, may be nondetachable from either shoe sock 101 and/or 102, and be comprised of a nondetachable mechanism 130, as shown in FIG. 6. In one aspect, the first attachment 118 attaches the first terminal end 114 to the top 105 of the first shoe sock 101 and the second attachment 119 attaches the second terminal end 115 to the top 105 of the second shoe sock 102. Nondetachable mechanism 130 may be sewn together, each sewn on to a ring made metal or plastic, or rivets sewn into the bag attaching strap 111. In another embodiment strap 111 is detachable from shoe sock 101 and/or 102. First attachment 118 and/or second attachment 119 may contain a detachable mechanism 129, as shown in FIG. 5. Detachable mechanism 129 may contain hooks; rings; buckles; snaps; clips; buttons; zippers; clasps; Velcro.

In one embodiment both shoe socks 101 and 101 are detachable or non-detachable and in another embodiment one shoe bag 101 is detachable while the other 102 is non-detachable. In an alternative embodiment one shoe bag 102 is detachable while the other 101 is non-detachable.

Strap 111 may be made from multiple kinds of material including stretchy fabric, leather, faux leather, suede, foam, nylon, string, any waterproof material or washable material, rolled leather; fabric covering foam, or a portion or all of strap 111 could be chain. Strap 111 may also have embroidery designs 111 as shown by FIG. 6, piping, threading, printed fabric on all or part of the strap, be multi colored, and/or it may contain a section of reflective material. The piping or threading on the strap may designed to match the colors of a logo or design, such as a sports team logo, on the exterior of one or both shoe socks 101 and 102. Strap 111 may vary in width from a thin strap to a thick strap covering the entire shoulder to allow for more comfort while carrying the shoe tote 100. In an alternative embodiment strap 111 may be split into two straps. In one embodiment the design on the strap is diagonal or horizontal stitching in the shape of a ring going around Strap 111 in equal distances from each other along strap 111. In other embodiments the diagonal or horizontal stitching may be spaced 2 inches apart. Strap 111 may be configured to be carried over one shoulder as shown in FIG. 1A. In another embodiment strap 111 may be configured to be worn around the neck of a wearer using the shoe tote 100. In yet another embodiment strap 111 may be configured to be carried by one or more hands of the user. In other aspects the shoe tote 100 may be thrown into a larger bag allowing the user to quickly find the shoe tote 100 when stored with a variety of other equipment. In yet another aspect strap 111 may be carried by one or more straps of another bag, such as a tote back, an athletic bag, or a backpack. In one aspect the strap 111 may be strung around the straps at the bottom of a backpack. In yet another aspect the first attachment 118 or the second attachment 119 may be attach the first shoe sock 101 or the second shoe sock to the strap 111 and another bag.

Figure 3A:
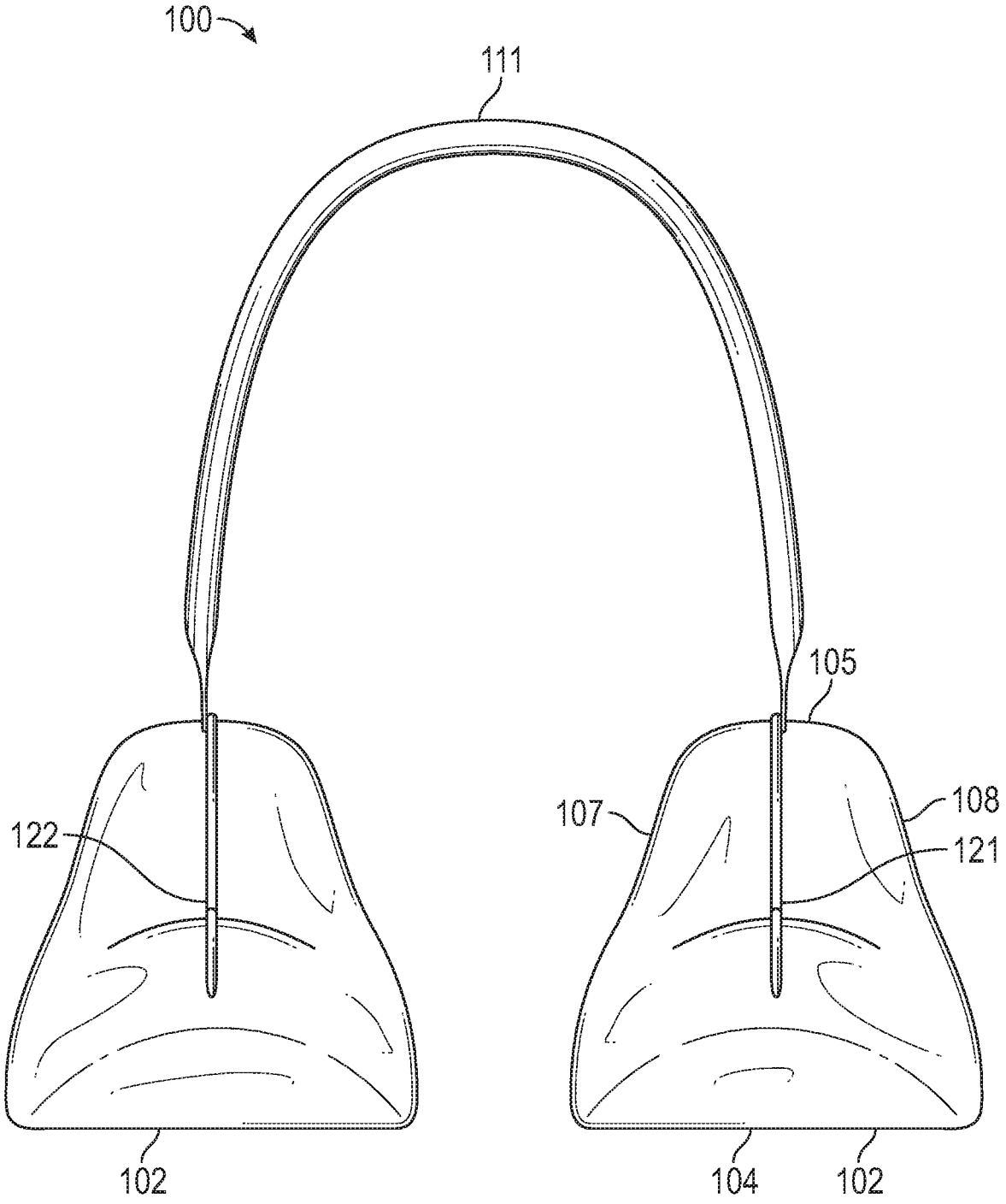
FIG. 3A is a perspective view of shoe tote 100 with the closure mechanism in the closed position in accordance with one embodiment of the present invention.
Figure 3B:
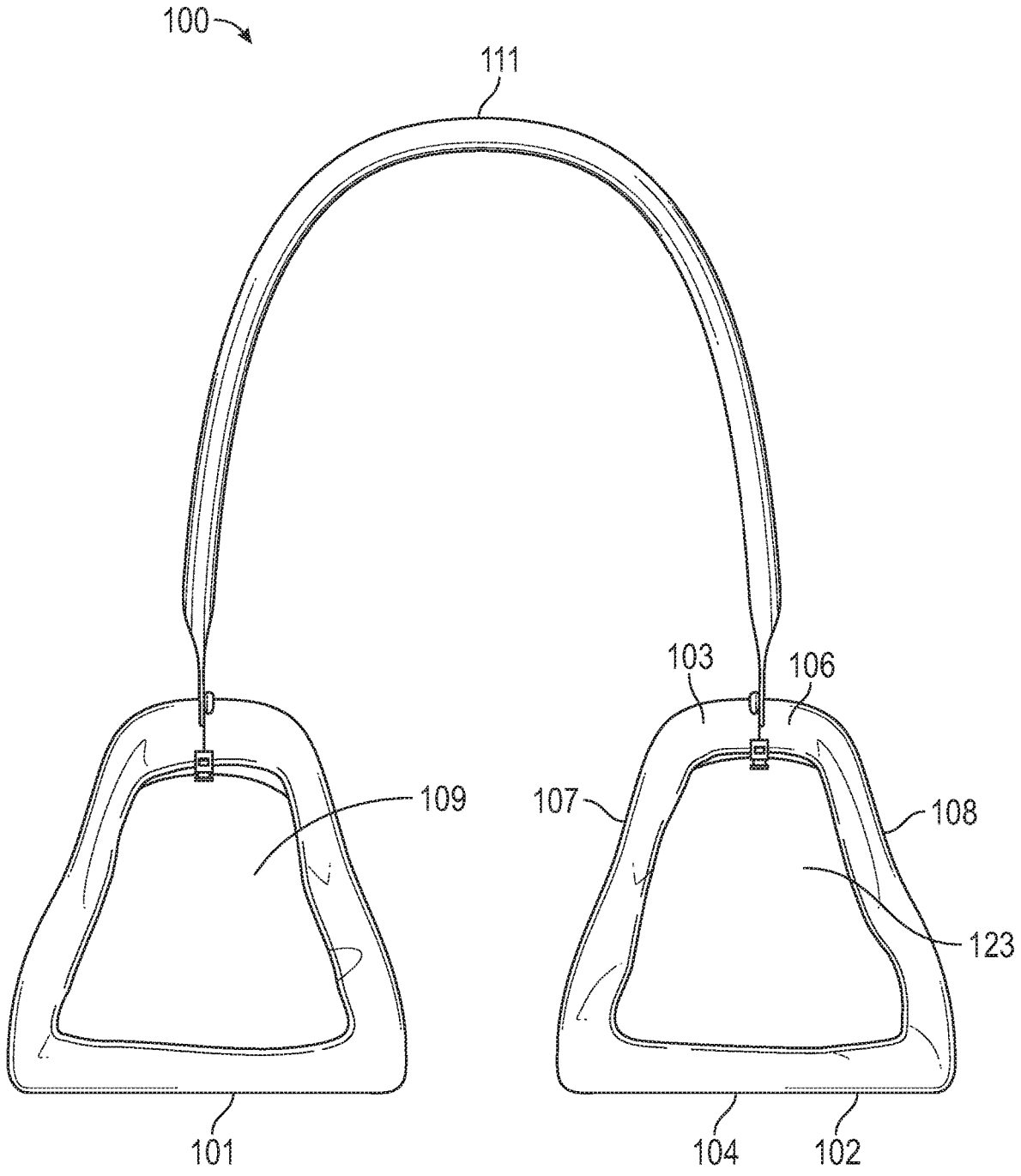
FIG. 3B is a side view of shoe tote 100 with the closure mechanism in the open position in accordance with one embodiment of the present invention.

The first and second shoe socks 101 and 102 have a first side wall 107 and an opposing second side wall 108 spaced apart by a bottom portion 104 and a back portion 103. Shoe socks 101 and 102 have a top portion 105 opposing the bottom portion 104 and a front portion 106 opposing the back portion 103. Shoe sock 101 or 102 may have a bottom portion 120 configured to ground contacting surface of the footwear. Shoe socks 101 and 102 have an exterior 110 opposing an interior 109 sized and shaped to receive at least one athletic shoe, boot, roller skate, ice skate, high top shoe, low top shoe or any other footwear item. Shoe socks 101 and 102 have a closure mechanism 121 where the opposing edges of the first side wall and the second side wall are contiguous in a closed position 122 and noncontiguous in an open position 123, as shown by FIGS. 3*a* and 3*b*. The closure mechanism may be comprised of Velcro; a zipper; at least one button; at least one snap; one or more drawstrings; lace with or without grommets; elastic; magnets;

aluminum clasps; or at least one buckle. Shoe socks 101 and 102 may also be designed with specialty piping 133 as shown in FIG. 6. The specialty piping 133 or spine may be on the top 105 of shoe sock 101 or shoe sock 102. The specialty pipe may aid a user on placement of the shoe in the shoe sock, allowing the shoe sock 101 or 102 to close easier. Shoe socks 101 and 102 may be two or more color tones (multi-color sides). Shoe socks 101 and 102 may have a design or logo on the exterior of the shoe sock. The design or logo, such as a sports team logo, may match the threading or piping on Strap 111. The shoe socks may have a translucent viewing panel 131, which may be located on the back portion 103, the bottom portion 104, the top portion 105, the front portion 106, the first side wall 107, or the second side wall 108 on at least one shoe sock allowing the wearer to see inside as shown by FIG. 6.

Figure 4:
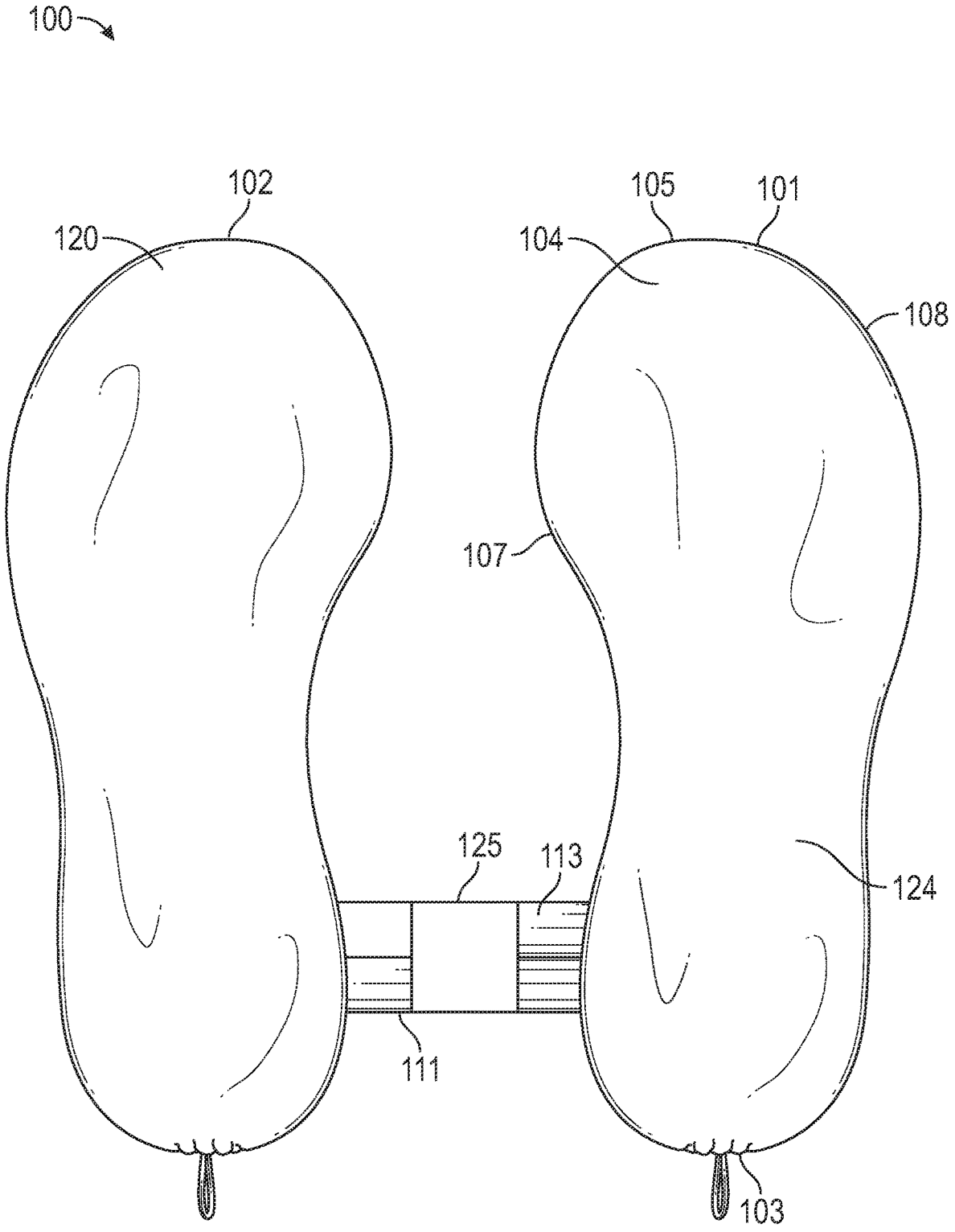
FIG. 4 is a bottom view of shoe tote 100 showing the cushioning pad and protective puncture pad in accordance with alternative embodiments of the invention.

Shoe socks 101 and 102 may be made from multiple kinds of material or fabric 126. In one embodiment the material is shape forming material 132, as shown by FIG. 5. In another embodiment the material making the shoe sock is one size fits all. In alternative embodiments the material might be cut to fit an individual's shoe size. The fabric may be breathable, allowing the odors to dissipate. The fabric may also be odor resistant, so the shoe sock does not smell after the shoe is taken out. The fabric may also be moisture wicking and/or water repellant to deal with the elements while the wearer is using the shoe tote. Shoe sock 101 or 102 may have a cleanser shoe surface fabric. The fabric may be rolled over the athletic shoe when the shoe is being place in the shoe sock 101 or 102. The fabric may allow for a portion if not all of shoe sock 101 or 102 to be translucent or allowing the user to see inside or opaque keeping the contents hidden. The material may be anti-microbial and or stain resistant. The shoe sock bottom portion 120 may be made from the same material as the rest of the bag. In other embodiments the shoe socks bottom portion 120 may be made from harder material such as rubber, or it may be protective puncture pad 124, as shown by FIG. 4. One or both shoe socks, 101 and 102 may include double layered socks 128, as shown by FIG. 5. One layer of the shoe sock may be made of helenka fabric and the outer layer may be made of a shiny nylon lycra spandex material or a 4 way stretch material. The inner lining helps with durability with cleats, spikes or any ground contacting surface with a pointed edge, preventing the ground contacting surface from puncturing the fabric.

Referring to FIG. 3, a shoe tote 100 is shown in accordance with one embodiment of the present invention. FIG. 3A shows closure mechanism 121 in the closed position 122 where the opposing edges of the first side wall 107 and the second side wall 108 are contiguous. FIG. 3*b*. shows closure mechanism 122 in the open position 123 where the opposing edges of the first side wall 107 and the second side wall 108 are noncontiguous.

Referring to FIGS. 4-7, there are shown additional features of the shoe tote system. In alternative embodiments of the present invention, strap 111 and/or one or both of the shoe socks 101 or 102 may include additional storage pockets 135, a pocket for a cooling gel towel 136 for the neck; a pocket for a vibration pack 144 for the neck; pouch with a hoodie 141; a hook 138; ID pouch 145; an electronic pocket 142; a media port 143, a cushioning pad 125, an adjustable mechanism 127, a key ring 137, a storage bag 139. It should be understood that any of these features is contemplated to be incorporated with any or all of the shoe socks or strap.

In one embodiment strap 111 may have a cushioning pad 125 that covers at least a portion of the shoulder, neck or is where the shoe tote system 100 is carried by hand as show by FIGS. 1A-C. Cushioning pad 125 in some embodiments may be moveable. In alternative embodiments strap 111 may have an adjustment mechanism 127 allowing the wearer to adjust the length of strap 111, as shown by FIG. 5. The adjustable mechanism may contain at least one of the following: a slider; a buckle; a button; a ring; a hook; a zipper; a snap; a clip; a latch; a clasp, Velcro.

Strap 111, first shoe tote 101, or second shoe sock 102 may include a storage pocket 135, as shown by FIG. 5. The pocket may be accessed Velcro; a zipper; at least one button; at least one snap; lace; elastic; magnets; aluminum clasps; or at least one buckle. In another embodiment the strap may contain an additional bag 140 as a storage. The storage pocket can be varying sizes. In one embodiment the storage pocket may only be large enough to store a power bar. In another embodiment the storage pouch might be large enough to fit a tennis racquet or other larger sports equipment. Storage pocket 135 may also be located in the interior or the exterior of one or both shoe socks 101 and 102.

As shown by FIG. 5, strap 111, first shoe tote 101, or second shoe sock 102 may include a cooling gel towel for neck stored in a pocket 136. The pocket may be accessed Velcro; a back zipper; a zipper that wraps around the shoe sock; at least one button; at least one snap; lace; elastic; magnets; aluminum clasps; cord closure linked to a clasp; cord closure linked to a cord lock; or at least one buckle. In an alternative embodiment strap 111 may include an additional bag 139 attached to strap 111 by an attachment mechanism with a pocket for cooling gel towel stored inside it. Additional embodiments may have the pocket 136 containing the cooling gel towel located in the interior or exterior of one or both shoe socks 101 or 102. In another embodiment strap 111 may contain a cooling gel cushioning pad 125 for when the strap is worn around the neck as shown in FIG. 1B. This cooling gel pad may be activated upon getting wet, pressure activated, temperature activation or it may be activated in a multitude of other ways to cool the wearer's neck. Strap 111 may also be detached from the shoe tote system 100 and stored in a freezer, fridge or any other cooling system to activating the cooling gel. Pocket 136 may also store heating pads to keep the strap or shoes warm in the winter, antimicrobial packets or deodorizers, or moisture absorbing packets such as silica packets.

Strap 111 may also include a vibration pack for the neck stored in a pocket 144 along the strap. The pocket may be accessed Velcro; a zipper; at least one button; at least one snap; lace; elastic; magnets; aluminum clasps; or at least one buckle. In an alternative embodiment strap 111 may include an additional bag attached to strap 140 with a vibration pack for the neck within a pocket 144 stored inside it. In another embodiment one of the shoe socks 101 or 102 may contain a pocket 144 that stores the vibration pad.

Strap 111 may include a pocket 141 with a hoodie. The pocket 141 may be closed by Velcro; a zipper; at least one button; at least one snap; lace; elastic; magnets; aluminum clasps; or at least one buckle. In another embodiment strap 111 may contain an additional bag 139 that contains a hoodie wherein the additional bag zips close. In another embodiment the pocket 141 with a hoodie is positioned on strap 111 close to the shoulder or the neck and the wearer can unzip the pocket 141 and pull out the hoodie. The hoodie may be sewn into the pocket 141. In an alternative embodiment one or both shoe socks 101 or 102 may contain pocket 135 with a hoodie. Pocket 141 may include a zipper pouch with a hoodie attached to the outside.

Strap 111 may include a hook 138 somewhere along the strap. This hook allows for other items to be attached to the strap such as a water bottle, additional bags, or additional sports equipment. The hook may be plastic or metal. In an alternative embodiment hook 138 may be attached to the metal or plastic ring; buckle; or hook that is attaching the strap to the shoe sock. In another embodiment hook 138 may be on one or both shoe socks 101 or 102.

An ID pocket 145 may be located somewhere on strap 111, as shown by FIG. 6. In another embodiment ID pocket 145 may be located on the outside of one of the shoe socks 101 or 102. In another embodiment ID pocket 111 may be located on the inside of shoe sock 101 or 102. ID pocket 145 is designed to fit an ID card, credit cards and cash. In one embodiment the ID pouch may be fixed on to the strap or one of the shoe socks. In another embodiment ID pocket 145 may be detachably connected so that the user can remove ID pouch 111 for use away from shoe tote 100. ID pocket 145 may be made of waterproof material to protect the items from getting wet. ID pocket 145 may have a transparent window allowing one to see its contents. ID pocket 145 may be closed by Velcro; a zipper; at least one button; at least one snap; lace; elastic; magnets; aluminum clasps; or at least one buckle or the pouch may have an opening allowing the wearer to just slide his or her ID, cards and cash in.

Electronics pocket 142 may be located somewhere on strap 111. Electronic pocket 142 may be specifically designed to house a cellular phone. In one embodiment the electronics pocket may be located on the outside of one of the shoe socks 101 or 102. In another embodiment the electronics pocket may be located on the inside of the shoe sock 101 or 102. Electronics pocket 142 be fixedly and removably connected to the shoe tote or it may be detachably connected so that the user can remove the cell phone, in its protective case, for use away from shoe tote system. Electronics pocket 142 may be made of waterproof material to protect the items from getting wet. Electronics pocket 142 may have a transparent window allowing one to see its contents. Electronics pocket 142 may have an opening or a media port 143 on the bottom of the pocket allowing a cable to exit the pocket. Electronics pocket 142 may be placed in a pocket with a lattice structure or a pocket with no material covering the front allowing the wearer to access the screen of a phone or another device while it is still in the pocket. The electronics pocket 142 may be configured to store headphones, ear phones, headsets, chargers, cords, phones, CD players, or any other electronics device.

A key ring 137 may be located somewhere on strap 111. In another embodiment the key may be located on the outside of one of the shoe socks 101 or 102. another embodiment the key ring may be located on the inside of shoe sock 101 or 102. The key ring may be a ring, loop or hook that allows the wearer to attach the keys to the shoe tote. This allows for easy access to the wearers keys and the keys are easily removable.

FIG. 8 shows shoe tote system 100 in accordance with another embodiment of the present invention. The shoe tote system generally includes two individual shoe totes, shoe sox or shoe socks. The shoe totes may be designated as first shoe sock 101 and second shoe sock 102 for description herein or for reference in a particular situation where a first and second footwear combination warrants a difference between the two shoe socks, but in most instances, there is not intended to be a perceived difference between the shoe socks as far as the terms first and second are concerned. The first and second shoe socks 101 and 102 have a first side wall 107 and an opposing second side wall 108 spaced apart by a bottom portion 104 and a back portion 103. Shoe socks 101 and 102 have a top portion 105 opposing the bottom portion 104 and a front portion 106 opposing the back portion 103. Shoe sock 101 or 102 may have a bottom portion 120 configured to ground contacting surface of the footwear. Shoe socks 101 and 102 have an exterior 110 opposing an interior 109 sized and shaped to receive at least one athletic shoe, boot, roller skate, ice skate, high top shoe, low top shoe or any other footwear item. Shoe socks 101 and 102 have a closure mechanism 121 where the opposing edges of the first side wall and the second side wall are contiguous in a closed position 122 and noncontiguous in an open position 123, as shown by FIGS. 3A and 3B. The first shoe sock 101 and the second shoe sock 102 may be configured to be carried by the hand of the wearer or may be configured to fit into a larger duffel bag of the user. The shoe tote fabric may be designed to protect shoe sock 101 and 102 when shoe socks 101 and 102 are inside the duffel bag.

The features, steps, and components of the illustrative embodiments may be combined in any number of ways and are not limited specifically to those described. In particular, the illustrative embodiments contemplate numerous variations in the shoe tote. The foregoing description has been presented for purposes of illustration and description. It is not intended to be an exhaustive list or limit any of the disclosure to the precise forms disclosed. It is contemplated that other alternatives or exemplary aspects are considered included in the disclosure. The description is merely examples of embodiments, processes or methods of the invention. It is understood that any other modifications, substitutions, and/or additions may be made, which are within the intended spirit and scope of the disclosure. For the foregoing, it can be seen that the disclosure accomplishes at least all of the intended objectives.

The previous detailed description is of a small number of embodiments for implementing the invention and is not intended to be limiting in scope. The following claims set forth a number of the embodiments of the invention disclosed with greater particularity.

What is claimed is:

1. A shoe tote for toting footwear comprising:

a first shoe sock having a first side wall and an opposing second side wall spaced apart by a bottom portion and a back portion, the back portion having an upper portion opposing a lower portion, the first shoe sock further comprising:

a top portion opposing the bottom portion;

a front portion opposing the back portion;

an exterior portion opposing an interior portion sized to receive a first footwear;

a closure mechanism disposed on the back portion, the closure mechanism having an open position wherein opposing edges of the first sidewall and the second side wall are noncontiguous and a closed position wherein opposing edges of the first sidewall and the second side wall are contiguous, wherein the closure mechanism further comprises:

a top closure portion opposing a bottom closure portion, the top closure portion disposed on the upper portion of the back portion of the first shoe sock and the bottom closure portion disposed on the lower portion of the back portion of the first shoe sock;

wherein the first side wall, the second sidewall, the bottom portion, the back portion, the front portion, and the exterior portion of the first shoe sock are comprised of a shape forming material;

piping disposed on a center of the top portion and a center of the front portion of the first shoe sock and the shape forming material, wherein the piping extends along the center of the front portion and the center of the top portion and terminates before the back portion of the first shoe sock at a first attachment point;

wherein an interior portion of the shape forming material of the first shoe sock conforms to the first footwear;

wherein a toe of the first footwear is disposed in the front portion of the first shoe sock to cover the toe of the first footwear with the front portion of the first shoe sock;

wherein the shape forming material covers and conforms to the first footwear by rolling the shape forming material from the toe of the first footwear to a heel of the first footwear and wherein the piping is configured to centralize the first footwear within the first shoe sock;

a second shoe sock having a first side wall and an opposing second side wall spaced apart by a bottom portion and a back portion, the back portion having an upper portion opposing a lower portion, the second shoe sock further comprising:

a top portion opposing the bottom portion;

a front portion opposing the back portion;

an exterior portion opposing an interior portion sized to receive a second footwear;

a closure mechanism disposed on the back portion having an open position wherein opposing edges of the first sidewall and the second side wall are noncontiguous and a closed position wherein the first sidewall and the second side wall are contiguous, wherein the closure mechanism further comprises:

a top closure portion opposing a bottom closure portion, the top closure portion disposed on the upper portion of the back portion of the second shoe sock and the bottom closure portion disposed on the lower portion of the back portion of the second shoe sock;

wherein the first side wall, the second side wall, the bottom portion, the back portion, the front portion, and the exterior portion of the second shoe sock are comprised of the shape forming material;

piping disposed on a center of the top portion and a center of the front portion of the second shoe sock and the shape forming material, wherein the piping extends along the center of the front portion and the center of the top portion and terminates before the back portion of the second shoe sock at a second attachment point;

wherein the interior portion of the shape forming of the second shoe sock conforms to the second footwear;

wherein a toe of the second footwear is disposed in the front portion of the second shoe sock to cover the toe of the second footwear with the front portion of the second shoe sock;

wherein the shape forming material covers and conforms to the second footwear by rolling the shape forming material from the toe of the second footwear to a heel of the second footwear and wherein the piping is configured to centralize the second footwear within the second shoe sock:

wherein the first and second shoe sock consists of a single strap having a length between a first terminal end and an opposing second terminal end, an outer surface opposing an inner surface, a first edge and an opposing second edge along the length and separated by the outer and inner surface of the strap, the first attachment point disposed between the first terminal end of the strap and the first shoe sock, wherein the first attachment point is disposed on the top portion and near the back portion of the first shoe sock and aligned along the center of the top portion and the center of the back portion of the first shoe sock, and the second attachment point disposed between the second terminal end of the strap and the second shoe sock, wherein the second attachment point is disposed on the top portion and near the back portion of the second shoe sock and aligned along the center of the top portion and center of the back portion of the second shoe sock.

2. A shoe tote as recited in claim 1, wherein at least one shoe sock further comprises of double layered socks.

3. A shoe tote as recited in claim 1, wherein a protective puncture pad is contained in the bottom portion of at least one shoe sock.

4. A shoe tote as recited in claim 1, further comprising of an adjustable mechanism, located on the strap.

5. A shoe tote as recited in claim 1, further comprising of a cushioning pad on the inner surface of the strap.

6. A shoe tote for toting footwear consisting of:

a first shoe sock having a first side wall and an opposing second side wall spaced apart by a bottom portion and a back portion, the back portion having an upper portion opposing a lower portion, the first shoe sock further comprising:

a top portion opposing the bottom portion;

a front portion opposing the back portion;

an exterior portion opposing an interior portion sized to receive a first footwear;

a closure mechanism having an open position wherein opposing edges of the first sidewall and the second side wall are noncontiguous and a closed position wherein opposing edges of the first sidewall and the second side wall are contiguous, wherein the closure mechanism further comprises:

a top closure portion opposing a bottom closure portion, the top closure portion disposed on the upper portion of the back portion of the first shoe sock and the bottom closure portion disposed on the lower portion of the back portion of the first shoe sock;

piping disposed on a center of the top portion and a center of the front portion of the first shoe sock, wherein the piping extends along the center of the front portion and the center of the top portion and terminates before the back portion of the first shoe sock;

wherein the first shoe sock consists of a shape forming material that conforms to an exterior of the first footwear;

a second shoe sock having a first side wall and an opposing second side wall spaced apart by a bottom portion and a back portion, the back portion having an upper portion opposing a lower portion, the second shoe sock further comprising:

a top portion opposing the bottom portion;

a front portion opposing the back portion;

an exterior portion opposing an interior portion sized to receive a second footwear;

a closure mechanism having an open position wherein opposing edges of the first sidewall and the second side wall are noncontiguous and a closed position wherein the first sidewall and the second side wall are contiguous, wherein the closure mechanism further comprises:

a top closure portion opposing a bottom closure portion, the top closure portion disposed on the upper portion of the back portion of the second shoe sock and the bottom closure portion disposed on the lower portion of the back portion of the second shoe sock;

piping disposed on a center of the top portion and a center of the front portion of the second shoe sock, wherein the piping extends along the center of the front portion and the center of the top portion and terminates before the back portion of the second shoe sock;

wherein the second shoe sock consists of the shape forming material that conforms to an exterior of the second footwear; and wherein the first shoe sock and the second shoe sock consist of a single carry strap connecting the first and second shoe socks and having a first terminal end and an opposing second terminal end, a first attachment point disposed between the first terminal end of the strap and a center of the top portion of the first shoe sock, a second attachment point disposed between the second terminal end of the strap and a center of the top portion of the second shoe sock.

7. The shoe tote system of claim 6 wherein at least one of the first attachment point or the second attachment point is comprised of a hook.

8. The shoe tote system of claim 6 wherein the closure mechanism of the first shoe sock is comprised of a lace.

9. The shoe tote system of claim 6 wherein the closure mechanism of the second shoe sock is comprised of a lace.

10. The shoe tote system of claim 6 wherein the first shoe sock and the second shoe sock are comprised of breathable material.

11. A shoe tote for toting footwear comprising:

a first shoe sock consisting of:

a first side wall and an opposing second side wall spaced apart by a bottom portion and a back portion, the back portion having an upper portion opposing a lower portion;

a top portion opposing the bottom portion;

a front portion opposing the back portion;

an exterior portion opposing an interior portion sized to receive one or more types of footwear having a ground contacting surface; wherein the bottom portion is configured to the ground contacting surface of the one or more types of footwear;

a closure mechanism having an open position wherein opposing edges of the first sidewall and the second side wall are noncontiguous and a closed position wherein opposing edges of the first sidewall and the second side wall are contiguous and a top closure portion opposing a bottom closure portion, the top closure portion disposed on the upper portion of the back portion of the first shoe sock and the bottom closure portion disposed on the lower portion of the back portion of the first shoe sock;

piping disposed on a center of the top portion and a center of the front portion of the first shoe sock, wherein the piping extends along the center of the front portion and the center of the top portion and terminates before the back portion of the first shoe sock at a first attachment point, wherein the piping is configured to centralize the first footwear in the first shoe sock; and a second shoe sock consisting of a first side wall and an opposing second side wall spaced apart by a bottom portion and a back portion, the back portion have an upper portion opposing a lower portion;

a top portion opposing the bottom portion;

a front portion opposing the back portion;

an exterior portion opposing an interior portion sized to receive one or more types of footwear having a ground contacting surface; wherein the bottom portion is configured to the ground contacting surface of the one or more types of footwear;

a closure mechanism having an open position wherein opposing edges of the first sidewall and the second side wall are noncontiguous and a closed position wherein opposing edges of the first sidewall and the second side wall are contiguous and a top closure portion opposing a bottom closure portion, the top closure portion disposed on the upper portion of the back portion of the second shoe sock and the bottom closure portion disposed on the lower portion of the back portion of the second shoe sock;

piping disposed on a center of the top portion and a center of the front portion of the second shoe sock, wherein the piping extends along the center of the front portion and the center of the top portion and terminates at a second attachment point, wherein the piping is configured to centralize the second footwear in the second shoe sock;

wherein the first side wall, the second sidewall, the bottom portion, the back portion, the front portion, and the exterior portion of the first shoe sock comprise a shape forming material;

wherein the first side wall, the second side wall, the bottom portion, the back portion, the front portion, and the exterior portion of the second shoe sock comprise the shape forming material;

wherein the shape forming material of the first shoe conforms to an exterior of the first footwear;

wherein the shape forming of the second shoe sock conforms to an exterior of the second footwear;

a single carry strap consisting of the first attachment point disposed between the first terminal end of the strap and the first shoe sock on the top portion and near the back portion of the first shoe sock and the second attachment point disposed between the second terminal end of the strap and the second shoe sock on the top portion and near the back portion of the second shoe sock.

12. The shoe tote system of claim 11 wherein the closure mechanism of the first shoe sock is comprised of a lace and a grommet.

13. The shoe tote system of claim 11 wherein the closure mechanism of the second shoe sock is comprised of a lace and a grommet.

14. A shoe tote as recited in claim 11, wherein the shape forming material is breathable.

* * * * *